US005707325A

United States Patent [19]

Chiou

[11] Patent Number: 5,707,325

[45] Date of Patent: Jan. 13, 1998

[54] EXERCISING DEVICE

[75] Inventor: Shu-Yen Chiou, Hsien Hsi Hsiang, Taiwan

[73] Assignee: Kingi Cycle Co., Ltd., Sanchugn, Taiwan

[21] Appl. No.: 790,615

[22] Filed: Jan. 29, 1997

[51] Int. Cl.[6] ..... A63B 21/22

[52] U.S. Cl. ..... 482/132; 482/127

[58] Field of Search ..... 482/132, 127

[56] References Cited

U.S. PATENT DOCUMENTS

| | | | |
|---|---|---|---|
| 2,821,394 | 1/1958 | Barbeau | 482/127 |
| 2,920,418 | 1/1960 | Britt | 482/132 |
| 3,403,906 | 10/1968 | Burzenski | 482/132 |
| 3,752,475 | 8/1973 | Ott | 482/127 |

FOREIGN PATENT DOCUMENTS 276503 5/1996 Taiwan .

*Primary Examiner*—Jerome Donnelly
*Attorney, Agent, or Firm*—Bacon & Thomas

[57] ABSTRACT

An exercising device is disclosed. The exercising device includes a roller device, having an axis, for rolling along a first direction from a start point, a first variation point, a second variation point to a stop point and along a second direction from the stop point, the second variation point, the first variation point, to the start point; an axle device for passing therethrough the axis; a first energy-storing device, connected to the roller device, for storing energy when the roller device rolls from the first variation point to the stop point and for releasing energy when the roller device rolls from the stop point to the first variation point; and a second energy-storing device, connected to the roller device, for storing energy when the roller device rolls from the second variation point to the stop point and for releasing energy when the roller device rolls from the stop point to the second variation point.

15 Claims, 3 Drawing Sheets

EXERCISING DEVICE

FIELD OF THE INVENTION

The present invention relates to an exercising device, and more particularly to an exercise wheel for strengthening the user's muscles.

BACKGROUND OF THE INVENTION

Physical fitness is a universal recognized goal, and for those who have no regular sports activities, a serious effort and discipline is a must. Moreover, regular exercise is beneficial for health. Because of the busy modem life and the limited living space, many indoor exercising devices are developed. The exercise wheel like many other indoor exercising devices are inexpensive, convenient, and adaptable to home use whenever the user's schedule permits. Therefore, the exercise wheel is popular and well accepted nowadays.

One related exercise wheel is disclosed in R.O.C. Pat. Publication No. 276503. The extent to which the spiral spring is wound up depends on the movement of the roller structure. When the spiral spring is completely wound up, the user will have a strong feeling of resistance, and therefore the slip-free effect is provided. Because the spiral spring of this related exercise wheel is suitable for only one direction, if the exercise wheel is used in the opposite direction, it is often easily damaged. In addition, the spiral spring of this related exercise wheel only provides a fixed torque coefficient, so the usage for this exercise wheel is limited.

From the above it is seen that an exercise wheel which is not easily damaged and with a multi-sectional force-displacement curve is often desired.

SUMMARY OF THE INVENTION

One objective of the present invention is to provide an exercise wheel which is not easily damaged.

Another objective of the present invention is to provide an exercise wheel with a multi-sectional force-displacement curve.

In a specific embodiment, the present invention provides an exercising device. This device comprises a roller device including an axis for rolling along a first direction from a start point, a first variation point, a second variation point to a stop point and along a second direction from the stop point, the second variation point, the first variation point, to the start point; an axle device for passing therethrough the axis; a first energy-storing device, connected to the roller device, for storing energy when the roller device rolls along the first direction and for releasing energy when the roller device rolls along the second direction; and a second energy-storing device, connected to the roller device, for storing energy when the roller device rolls from the second variation point to the stop point and for releasing energy when the roller device rolls from the stop point to the second variation point.

Certainly, the roller device can include two wheels. A rolling contact can exist between the axle device and the roller device. The axle device can include a bar and two handles. The two handles can be respectively connected to two ends of the bar.

Certainly, the first energy-storing device can include a first spiral spring connected to the roller device and the axle device. The first spiral spring can be wound up to store energy when the roller device rolls from the first variation point to the stop point and can be relaxed to release energy when the roller device rolls from the stop point to the first variation point. The exercising device can further include a first screw set device including a first set device and a second set device. The first set device can be engaged with the second set device. Each set device can include a screw thread and the second set device can be driven into the first set device. The second set device can be completely driven into the first set device when the roller structure reaches the first variation point.

Certainly, the second energy-storing device can include a second spiral spring connected to the roller device and the axle device. The second spiral spring can be wound up to store energy when the roller device rolls from the second variation point to the stop point and can be relaxed to release energy when the roller device rolls from the stop point to the second variation point. The exercising device can further include a second screw set device including a third set device and a fourth set device. The fourth set device can be engaged with the third set device. Each set device can include a screw thread and the fourth set device can be driven into the third set device. The fourth set device can be completely driven into the third set device when the roller structure reaches the second variation point.

Certainly, the first spiral spring can have a first torque coefficient and the second spiral spring can have a second torque coefficient. The first torque coefficient can be different from the second torque coefficient.

Certainly, a distance from the start point to the first variation point can be at a length at least zero.

Certainly, the roller device can roll from the start point and along the second direction opposite to the first direction. The first spiral spring and the second spiral spring can be designed not to store energy when the roller device rolls along the second direction from the start point. The first spiral spring and the second spiral spring can be designed not to release energy when the roller device rolls along the second direction from the start point.

The forgoing and other objects, features, and advantages of the invention will be apparent from the following more particular description of a preferred embodiment of the invention, as illustrated in the accompanying drawings.

DETAILED DESCRIPTION OF THE PREFERRED EMBODIMENT

Figure 1:
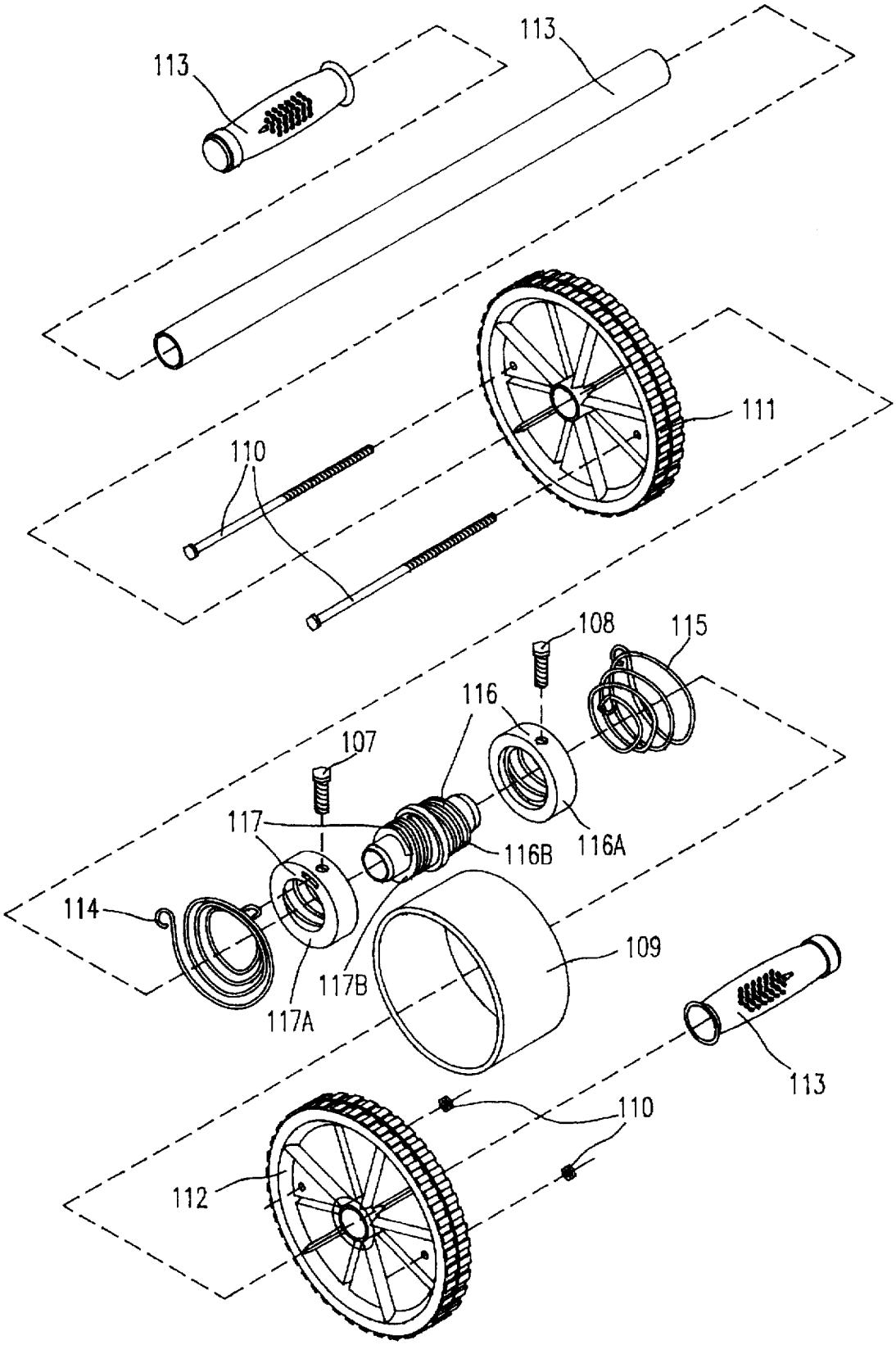
FIG. 1 illustrates an exploded view showing a preferred embodiment of an exercise device according to the present invention.

FIG. 1 illustrates a preferred embodiment of an exercise according to the present invention. Two wheels or rolling elements 111, 112 are connected by a bolt set 110. The wheels 111, 112 and a cylindrical housing 109 form a roller structure. A handle bar 113 passes through the axes of the wheels 111, 112. Rolling contact exists between the wheels 111, 112 and the handle bar 113. According to the present invention, the energy-storing elements for achieving the back-and-forth movement of the exercise wheel are two spiral springs 114, 115. One end of the spiral spring 114 is fixed to the bolt set 110 and the other end of spiral spring 114 is fixed to a screw set device 117 by a screw 107. One end of the spiral spring 115 is fixed to the bolt set 110 and the other end of spiral spring 115 is fixed to a screw set device 116 by a screw 108. The screw set device 117 includes a first set device 117A and a second set device 117B. The screw set device 116 includes a first set device 116A and a second set device 116B.

Figure 2:
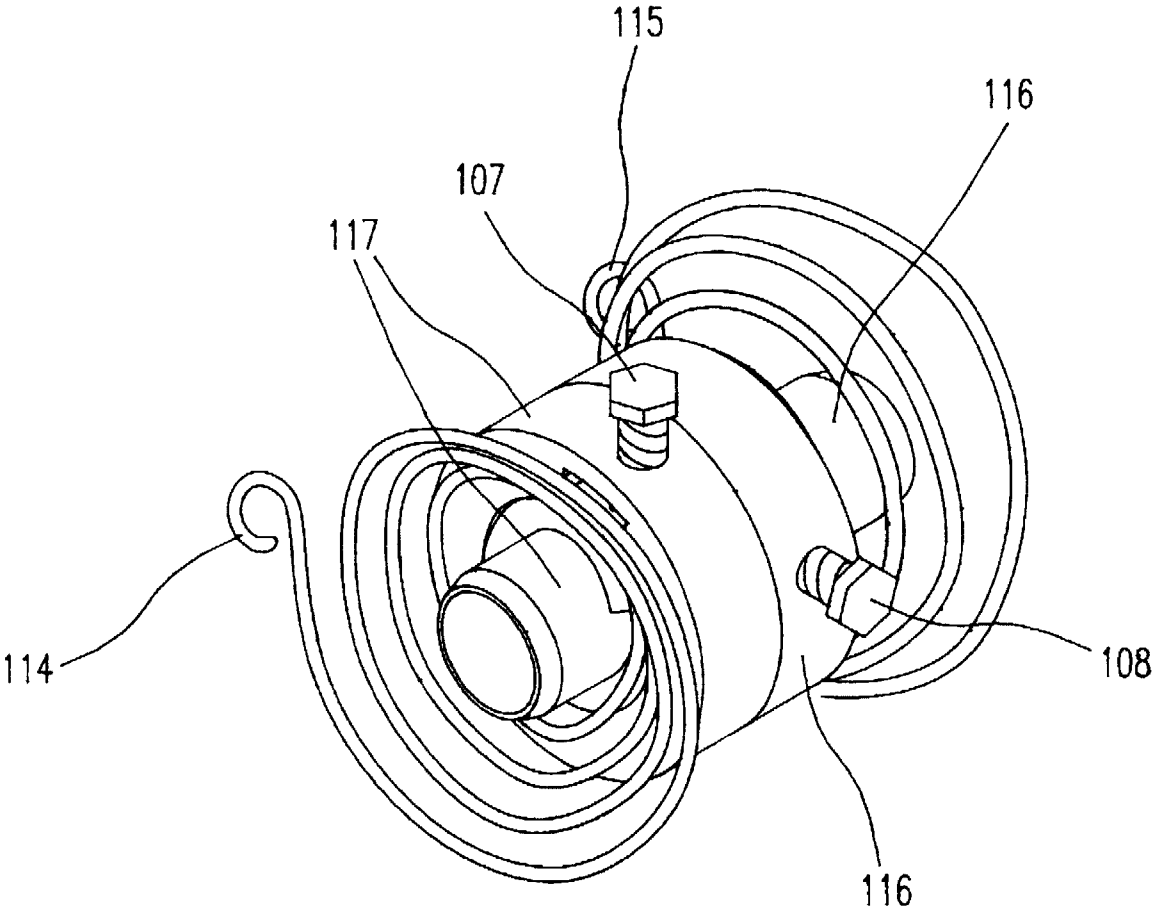
FIG. 2 illustrates the spiral spring and the screw set device of an exercise device according to the present invention.

FIG. 2 illustrates the spiral spring and the screw set device of one embodiment according to the present invention. When the user exerts a forward force on the handle bar 113, in response to the roller structure rolling along the first rolling direction (the forward direction), the second set device 117B begins to be driven into the first set device 117A. During this period of time, no resistance exists.

When the roller structure reaches the first variation point, the spiral spring 114 begins to be wound up, so the energy is stored and the resistance to the user is generated. At this time, the second set device 116B is still not completely driven into the first set device 116A, so the spiral spring 115 does not store the energy and the resistance due to the spiral spring 115 is generated.

When the user allows the roller structure to roll for a second distance to the second variation point, the second set device 116B is completely driven into the first set device, and the spiral spring 115 begins to be wound up to store the energy and the uses also begins to feel the resistance due to the spiral spring 115. At this time, the spiral spring 114 and the spiral spring 115 both operate. The resistance is gradually larger and finally the roller structure will stop.

The roller structure now moves along the second direction opposite to the first direction (the backward direction) from the stop point to the second variation point, and the energy is released to provide a force to assist the user to roll the roller structure backward.

When the roller structure returns to the second variation point, the second set device 116B begins to be driven loosely from the first set device 116A, and the second spiral spring 115 begins to have no effect on the operation. Now, only the first spiral spring 114 provides the force to assist the user to roll the roller structure back to the first variation point.

After the roller structure reaches the first variation point, the first spiral spring 114 begins to have no effect on the operation. When the user moves his roller structure from the starting point along the second direction opposite to the first direction (the reverse direction), the second set device 117B is driven loosely from the first set device 117A. And the second set device 116B is also driven loosely from the first set device 116A. Thus, the screw set device 116, 117 has no effect on the operation.

According to the present invention, the damage resulting from the reverse direction use is avoided. In addition, a back-and-forth exercise wheel with a multi-sectional force-displacement curve is provided.

Figure 3A:
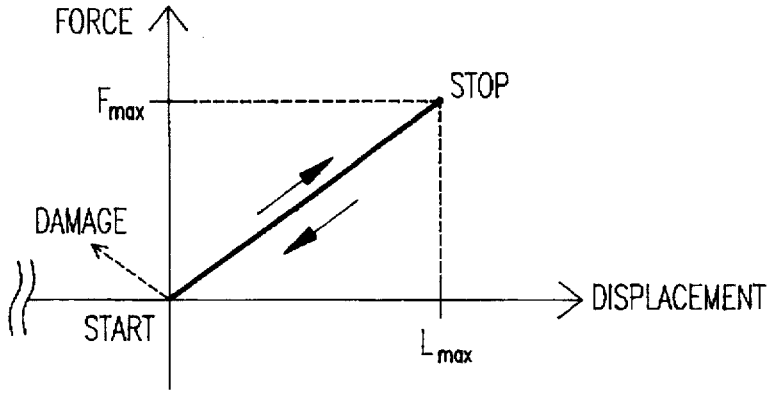
FIG. 3A illustrates a relation between the force exerted on the wheel and the corresponding displacement when the user uses the abovementioned related exercise wheel.

FIG. 3A illustrates a relation between the force exerted on the wheel and the displacement when the user uses the above-mentioned related exercise wheel (device). As shown in FIG. 3A, in response to the force, the roller structure moves along a first direction (or forward direction) from the starting point. After the resistance reaches Fmax and the distance reaches Lmax, the roller structure stops. The user then must resist the force from the spring and allow the roller structure to return to the starting point. Apparently, during the use, the relation between the force and the displacement is a straight line, and multi-sectional force-displacement curve is not provided. In addition, the movement of the reverse direction from the start point easily results in the damage of the exercise wheel.

Figure 3B:
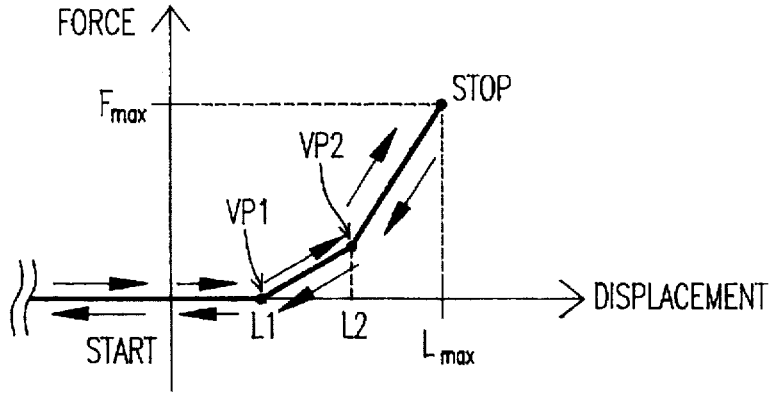
FIG. 3B illustrates a relation between the force exerted on the wheel and the corresponding displacement when the user uses an exercise device of the present invention.

FIG. 3B illustrates a relation between the force exerted on the wheel and the displacement when the user uses one embodiment of the present exercise wheel. Referring to FIG. 3B, in response to the force, the roller structure moves along a first direction (or forward direction) from the starting point. After a distance L1, the exercise wheel reaches the first variation point VP1, because of the operation of the first spiral spring, a first resistance is generated and increased. The relation between the resistance and the displacement L1 is shown in FIG. 3B. After a distance L2, the exercise wheel reaches the second variation point VP2, because of the operation of the first and second spiral springs, a second resistance is generated and increased. The resistance between the resistance and the displacement L2 is also shown in FIG. 3B. After the resistance reaches Fmax, the roller structure stops. The user then must resist the force from the springs and allow the roller structure to roll along the second direction (reverse direction). Whereas, when the user moves the roller structure from the start point along the second direction opposite to the first direction (i.e., the reverse direction), the first screw set device 117 and the second screw set device 116 both have no effect on the operation of the roller structure. The damage resulting from the reverse direction use can be avoided.

Figure 3C:
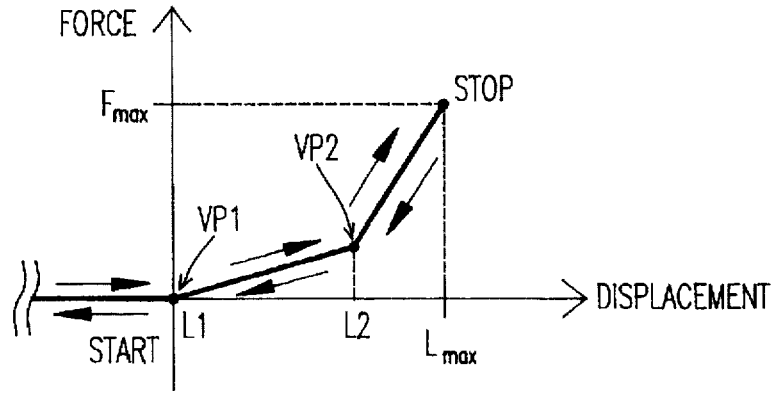
FIG. 3C illustrates a relation between the force exerted on the wheel and the displacement when the user uses another preferred embodiment of an exercise device according to the present invention.

FIG. 3C illustrates a relation between the force exerted on the exercise wheel and the displacement when the user uses another embodiment of the present exercise wheel. If the first variation point VP1 is adjusted so that the first variation point and the starting point are the same (that is, the location where the second set device 117B is completely driven into the first set device is adjusted), a two-sectional force-displacement curve is obtained.

Certainly, the torque coefficient of the first spiral spring and the torque coefficient of the second spiral spring can also be properly adjusted to obtain a desired curve and the corresponding exercise wheel.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. An exercising device comprising:

a roller device, comprising an axis, for rolling along a first direction from a start point, a first variation point, a second variation point to a stop point and along a second direction from said stop point, said second variation point, said first variation point, to said start point;

an axle device passing passing through said roller device along said axis;

first and second spiral connected to said roller device and said axle device;

a first screw set device, connected to said roller device, so as to cause said first spiral spring to store energy when said roller device rolls along said first direction and release energy when said roller device rolls along said second direction; and a second screw set device, connected to said roller device, so as to cause said second spiral spring to store energy when said roller device rolls from said second vibration point to said stop point and to release energy when said roller device rolls from said stop point to said second variation point.

2. An exercising device as set forth in claim 1 wherein said roller device comprises two wheels.

3. An exercising device as set forth in claim 1 wherein a rolling contact exists between said axle device and said roller device.

4. An exercising device as set forth in claim 1 Wherein said axis device comprises a bar and two handles, said two handles respectively connected to two ends of said bar.

5. An exercising device as set forth in claim 1 wherein said first spiral spring is wound up to store energy when said roller device rolls from said first variation point to said stop point and is relaxed to release energy when said roller device rolls from said stop point to said first variation point.

6. An exercising device as set forth in claim 1, further comprising a first screw set device comprises a first set device and a second set device, each comprising a screw thread and said second set device is able to be driven into said first set device.

7. An exercising device as set forth in claim 6 wherein said second set device is completely driven into said first set device when said roller structure reaches said first variation point.

8. An exercising device as set forth in claim 1 wherein said second spiral spring is wound up to store energy when said roller device rolls from said second variation point to said stop point and is relaxed to release energy when said roller device rolls from said stop point to said second variation point.

9. An exercising device as set forth in claim 1, wherein said second screw set device comprises a third set device and a fourth set device, each comprising a screw thread wherein said fourth set device is able to be driven into said third set device.

10. An exercising device as set forth in claim 9 wherein said fourth set device is completely driven into said third set device when said roller structure reaches said second variation point.

11. An exercising device as set forth in claim 1 wherein first spiral spring has a first torque coefficient and said second spiral spring has a second torque coefficient, said first torque coefficient being different from said second torque coefficient.

12. An exercising device as set forth in claim 1 wherein a distance from said start point to said first variation point is at a length at least of zero.

13. An exercising device as set forth in claim 1 wherein said roller device rolls from said start point along said second direction opposite to said first direction.

14. An exercising device as set forth in claim 13 wherein said first spiral spring and said second spiral spring do not store energy when said roller device rolls along said second direction from said start point.

15. An exercising device as set forth in claim 13 wherein said first spiral spring and said second spiral spring do not release energy when said roller device rolls along said second direction from said start point.

* * * * *